United States Patent [19]

Masuda et al.

[11] 3,997,346

[45] Dec. 14, 1976

[54] METHOD FOR STABILIZING THE IMAGE OF A THERMALLY DEVELOPABLE PHOTOSENSITIVE MATERIAL

[75] Inventors: Takao Masuda; Shinpei Ikenoue, both of Asaka, Japan

[73] Assignee: Fuji Photo Film Co., Ltd., Minami-ashigara, Japan

[22] Filed: Sept. 11, 1974

[21] Appl. No.: 505,174

[30] Foreign Application Priority Data

Sept. 11, 1973 Japan ..... 48-102337

[52] U.S. Cl. ..... 96/50 PL; 96/61 R; 96/114.1

[51] Int. Cl.[2] ..... G03C 5/26; G03C 5/38; G03C 1/02

[58] Field of Search ..... 96/114.1, 50 PL, 61

[56] References Cited

UNITED STATES PATENTS

| | | | |
|---|---|---|---|
| 3,615,489 | 10/1971 | Fassbender | 96/50 R |
| 3,617,289 | 11/1971 | Ohkubo | 96/61 R |
| 3,839,041 | 10/1974 | Hiller | 96/114.1 |
| 3,856,526 | 12/1974 | Hamb et al. | 96/114.1 |
| 3,856,527 | 12/1974 | Hamb et al. | 96/114.1 |

*Primary Examiner*—Mary F. Kelley

*Attorney, Agent, or Firm*—Sughrue, Rothwell, Mion, Zinn & Macpeak

[57] ABSTRACT

In a method for forming an image in a thermally developable photosensitive material which comprises imagewise exposing a thermally developable photosensitive material comprising a support having thereon a layer containing at least (a) an organic silver salt; (b) a catalytic amount of a photosensitive silver halide or a compound capable of forming a silver halide upon reaction with the organic silver salt (a); (c) a reducing agent and (d) a binder and heating the thermally developable photosensitive material, the improvement which comprises stabilizing the image formed by contacting the photosensitive layer of the photosensitive material during or after the heating with a polymer film layer containing a compound represented by the following general formula

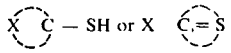

in which X represents the non-metallic atoms necessary for forming a heterocyclic ring.

21 Claims, No Drawings

METHOD FOR STABILIZING THE IMAGE OF A THERMALLY DEVELOPABLE PHOTOSENSITIVE MATERIAL

BACKGROUND OF THE INVENTION

1. Field of the Invention

This invention relates to a thermally developable photosensitive material, in particular, which is stabilized to light and heat.

2. Description of the Prior Art

Photographic processes using silver halides have superior photographic properties such as photosensitivity and gradation as compared with electrophotographic processes and diazotype photocopying processes. However, the silver halide light-sensitive materials used in the photographic processes are developed with developing solutions and then subjected to several processings such as stopping, fixing, washing with water and stabilizing in order to prevent the developed images from discoloring or fading under normal light and to prevent the nondeveloped areas (which will hereinafter be referred to as "background") from blackening. Therefore, these processings are time consuming and laborious and, in addition, create a problem in that the handling of chemicals is hazardous to the human body and the chemicals contaminate the processing rooms and the hands and clothes of the workers. In the photographic process using a silver halide, it is very desirable to carry out the processings in a dry condition without using solutions and to stabilize the processed image.

To this end, various approaches have hitherto been made. For example, the first approach is the so-called one bath developing and fixing method wherein the development and fixing in the silver halide photographic process of the prior art are carried out in one operation, as described in U.S. Pat. No. 2,875,048, British Pat. No. 954,453 and German Pat. No. 1,163,142. The second approach is an effort to carry out in a dry condition the processings of the silver halide photographic process which have hitherto been carried out using a wet process, as described in German Pat. No. 1,174,159 and British Pat. Nos. 943,476 and 951,644. The third approach is an effort to use a light-sensitive element consisting mainly of a silver salt of an aliphatic carboxylic acid such as, for example, behenic acid, silver saccharin or silver benzotriazole with a catalytic amount of a silver halide, as described in Japanese patent publications Nos. 4921/1968, 4924/1968, 26582/1969, 18416/1970, 12700/1970 and 22185/1970 and British Pat. No. 1,205,500.

The present invention relates to the third approach of the above described three approaches.

It is known that when a thermally developable photosensitive material obtained by coating onto a support in a monolayer or as multilayers (a) a non-photosensitive and reducible organic silver salt such as silver behenate or silver benzotriazole, (b) a very small amount of a photosensitive material, that is, silver halide or an inorganic halide which forms a light-sensitive silver halide by reaction with the non-photosensitive silver salt (a) and (c) a reducing agent with (d) a suitable binder is used, a stable image can be obtained by exposing and then developing in a dry process without fixing and other processings. The so thermally developed image can be maintained stable for a sufficiently long time at room temperature even under exposure to white light without subjecting the material to a subsequent fixing or stabilization, but, when the material is stored at a high temperature and high humidity, in particular, under exposure to white light, a slight development proceeds gradually and the background gradually turns brown. Therefore, the nonexposed area must be stabilized, in particular, where a copy which is to be stored permanently is desired.

In order to solve this problem, a proposal has been made to improve the photosensitive material imagewise exposed and thermally developed by treating the material with a solution containing a stabilizer as disclosed in Japanese patent publication No. 5393/1971. That is to say, this method for the stabilization of a developed image of a thermally developable photosensitive material, which comprises a dispersion in a binder (d) of the four components of (a) silver benzotriazole, (b) at least one of a silver halide and an inorganic halide capable of forming a silver halide by reaction with (a), (c) a reducing agent and (e) an organic carboxylic acid or a salt thereof, in which the resulting dispersion of these components has been coated onto a support in a monolayer or as multilayers, comprises treating the resulting thermally developable photosensitive material, after exposure and thermal development, with a stabilizing solution containing an organic compound represented by the following general formula,

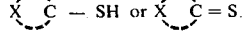

However, this method destroys a feature of the thermally developable photosensitive material in that when such a treating solution is used, the method is no longer a dry process.

On the contrary, this invention does not need any treating solution and thus the dry processing aspects of the thermally developable sensitive material are retained.

SUMMARY OF THE INVENTION

An object of this invention is to provide a thermally developable photosensitive material which is stable to heat and light after being processed.

Another object of this invention is to provide a thermally developable photosensitive material which is stabilized to light and heat without using any treating solution.

A further object of this invention is to provide a thermally developable photosensitive material having a coating layer which has excellent heat resistance. An even further object of the present invention is to provide a method of forming a stabilized developed image in a thermally developable photosensitive material.

In accordance with the present invention, a method is provided for the treatment of a thermally developable photosensitive material, which comprises imagewise exposing a thermally developable photosensitive material comprising a support having thereon a layer of (a) an organic silver salt, (b) a catalytic amount of a photosensitive silver halide or a component which forms a silver halide, (c) a reducing agent and (d) a binder and, during or after heating and developing of the exposed photosensitive material, contacting the photosensitive layer thereof with a polymer film layer containing at least one stabilizer.

This invention provides a method for forming an image in a thermally developable photosensitive material which comprises imagewise exposing a thermally developable photosensitive material comprising a support having thereon a layer containing at least (a) an organic silver halide salt; (b) a catalytic amount of a photosensitive silver halide or a compound capable of forming a silver halide upon reaction with the organic silver salt (a); (c) a reducing agent and (d) a binder and heating the thermally developable photosensitive material, the improvement which comprises stabilizing the image formed by contacting the photosensitive layer of the photosensitive material during or after the heating with a polymer film layer containing a compound represented by the following general formula,

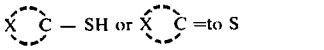

in which X represents the non-metallic atoms necessary for forming a heterocyclic ring.

DETAILED DESCRIPTION OF THE INVENTION

The stabilizer used in the invention is an organic compound represented by the following general formula,

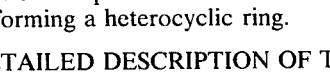

in which X represents the non-metallic atoms necessary for forming a substituted or unsubstituted heterocyclic ring. Illustrative examples of this heterocyclic ring formed by X are 5- or 6-membered heterocyclic rings containing at least one of a nitrogen, oxygen or sulfur hetero atom such as imidazolyl, benzoimidazolyl, thiazolyl, benzothiazolyl, oxazolyl, benzoxazolyl, triazolyl, thiadiazolyl, oxadiazolyl, tetrazolyl, pyridyl, pyrimidyl, pryazinyl, pyridazinyl and triazinyl rings.

Examples of the above described compound suitable for the present invention are 2-mercaptoimidazole 2-mercaptobenzoimidazole, 5-carboethoxy-2-mercapto-4-methylthiazole, 2-mercaptobenzothiazole, 2-mercaptoxazole, 2-mercaptobenzoxazole, 3-mercapto-4-phenyl-1,2,4-triazole, 3-mercapto-4,5-dimethyl-1,2,4-triazole, 4-mercapto-6-methyl-1,3,3a,7-tetrazaindene, 2-methylthio-4 -methyl-thiadiazole-5-thione, 3-phenyl-2-oxadiazoline-5-thione, 1-phenyl-5-mercaptotetrazole, 3-mercaptopyridine, 4-hydroxy-2-mercapto-6-methylpyrimidine, 2-mercaptopyrazine, 3-mercaptopyridazine and 2,4,6-trimercapto-1,3,5-triazine.

The amount of the stabilizer employed according to the present invention is about 0.1 to 200 parts by weight, preferably 1 to 100 parts by weight, per 100 parts by weight of the polymer forming the polymer film.

Examples of film forming polymers which are heat resistant, uncolored or only slightly colored and soluble in solvents, suitable for use in the invention, are polyvinyl chloride, polyvinyl acetate, vinyl chloride and vinyl acetate copolymers, polyvinyl butyral, polystyrene, polymethyl methacrylate, polyurethane rubbers, xylene resins, benzyl cellulose, vinyl chloride and vinylidene chloride copolymers, fluoroethylene resins, nylon-6, regenerated cellulose (cellophane), ethyl cellulose, cellulose acetate butyrate, cellulose acetate, polyvinylidene chloride, chlorinated polypropylene, polyvinyl pyrrolidone, cellulose propionate, polyvinyl formal, cellulose acetate phthalate, polycarbonate and cellulose acetate propionate. Gelatin, gelatin derivatives, acrylamide polymers, chlorinated rubbers, polyisobutylene, butadiene and styrene copolymers, vinyl chloride and vinylidene chloride copolymers and polyvinyl alcohol are also preferred examples.

These polymers can be used by themselves in the form of a film or can be applied to a film support to form a polymer layer containing a stabilizer. The total thickness of the polymer film is not particularly limited, but ordinarily is about 1 to 500 microns, preferably 10 to 200 microns. Adhesion of a single or composite polymer film containing such a stabilizer preferably is carried out using an adhesive or heat-fusible polymer. Examples of adhesives which are suitable are the pressure-sensitive adhesives commonly used for cellophane tapes, for example, vinyl acetate resins, acrylic acid ester resins, vinyl chloride-vinyl acetate resins and butadiene-styrene copolymer resins. Polyolefin type resins can also be used as the heat-fusible polymer.

In addition to the examples wherein the above described polymer and stabilizer are coated onto a film support in the form of a polymer film, the polymer film sheet for the stabilization can be obtained by incorporation of the stabilizer into the polymer during formation of the polymer film sheet. In addition, a composite film can be employed and examples of the composite film are as follows: Saran/PE, PET/Saran, PET/-PVA/PE, PP/PVA/PE, PET/PVA/PP, TAC/PVA/PP, PET/Cellophane/PE, TAC/Cellophane/PE, PP/Cellophane/PE, TAC/nylon-6/PE, PET/nylon-6/PE and PP/nylon-6/PE. In the above, Saran is a trade name of the Dow Chemical Company and designates a copolymer of vinyl chloride and vinylidene chloride. In addition, in the above, PE represents polyethylene; PET represents polyethylene terephthalate; PVA represents polyvinyl alcohol; PP represents polypropylene; and TAC represents cellulose triacetate. A suitable amount of the stabilizer can range from about 0.0001 g to 5 $g/m^2$ of the film and from about $10^{-5}$ to 1 mole per mole of the organic silver salt (a).

Such a polymer film sheet is contacted with a thermally developable photosensitive material, preferably a layer containing organic silver salt (a) or the silver halide (b), for example, by applying a pressure thereto and causing the film sheet and the photosensitive material to adhere, or by subjecting the photosensitive material and the film sheet to a heat sealing method with tight contact so that there is scarcely a gaseous phase at the boundary of the light-sensitive layer and the film sheet.

In addition to the stabilizers, yellow dyes or ultraviolet light absorbers, preferably, capable of effectively absorbing visible to ultraviolet light of a wavelength of less than 500 m$\mu$ and fillers such as silicon dioxide, titanium dioxide, zinc oxide, kaolin, starch and alumina for the purpose of rendering the sheet capable of being written upon with a pencil or ball-point pen can be incorporated in this polymer film sheet.

As the organic silver salt (Component (a)), the silver salts of organic compounds having an imino group, a mercapto group or a carboxy group, for example, silver benzotriazole, silver saccharin, silver phthalazinone, silver 3-mercapto-4-phenyl-1,2,4-triazole, silver 4-hydroxy-6-methyl-1,3,3a,7-tetrazaindene, silver 2-(S-ethylthioglycolamido)-benzothiazole, silver caprate, silver laurate, silver myristate, silver palmitate, silver stearate, silver behenate, silver adipate and silver sebacate, can be used.

As the reducing agent (Component (c)) of the invention compounds capable of reducing the organic silver salts when heated in the presence of exposed silver halide and thus giving a silver image should be used. A suitable reducing agent, depending upon the combination with the organic silver salt, is usually chosen from substituted phenols, substituted or unsubstituted bisphenols, substituted or unsubstituted naphthols, di- or polyhydroxybenzenes, di- or polyhydroxynaphthalenes, hydroquinone monoethers, ascorbic acid or its derivatives, 3-pyrazolidones, pyrazolidine-5-ones, reducing saccharides, kojic acid and hinokitiol. Specific examples of these compounds include hydroquinone, methylhydroquinone, chlorohydroquinone, bromohydroquinone, phenylhydroquinone, hydroquinonemonosulfonate, t-octylhydroquinone, t-butylhydroquinone, 2,5-dimethylhydroquinone, 2,6-dimethylhydroquinone, methoxyhydroquinone, ethoxyhydroquinone, p-methoxyphenol, p-ethoxyphenol, hydroquinone monobenzyl ether, catechol, pyrogallol, resorcinol, p-aminophenol, o-aminophenol, N-methyl-p-aminophenol, 2-methoxy-4-aminophenol, 2,4-diaminophenol, 2-$\beta$-hydroxyethyl-4-aminophenol, p-t-butylphenol, p-t-amylphenol, p-cresol, 2,6-di-t-butyl-p-cresol, p-acetophenol, p-phenylphenol, o-phenylphenol, 1,4-dimethoxyphenol, 3,4-xylenol, 2,4-xylenol, 2,6-dimethoxyphenol, sodium 1-amino-2-naphthol-6-sulfonate, 1-naphthylamine-7-sulfonic acid, 1-hydroxy-4-methoxynaphthalene, 1-hydroxy-4-ethoxy-naphthalene, 1,4-dihydroxynaphthalene, 1,3-dihydroxynaphthalene, 1-hydroxy-4-aminonaphthalene, 1,5-dihydroxynaphthalene, 1-hydroxy-2-phenyl-4-methoxynaphthalene, 1-hydroxy-2-methyl-4-methoxynaphthalene, $\alpha$-naphthol, $\beta$-naphthol, 1,1'-dihydroxy-2,2'-binaphthyl, 4,4'-dimethoxy-1,1'-dihydroxy-2,2'- binaphthyl, 6,6'-dinitro-2,2'dihydroxy-1,1'-binaphthyl, bis(2-hydroxy-1-naphthyl)methane, bisphenol A, 1,1-bis-(2-hydroxy-3,5-dimethylphenyl)-3,5,5-trimethylhexane, 2,4,4-trimethylpentyl-bis-(2-hydroxy-3,5-dimethylphenyl)methane, bis(2-hydroxy-3-t-butyl-5-methylphenyl)methane, bis(2-hydroxy-3,5-di-t-butylphenyl)methane, 4,4'-methylenebis(3-methyl-5-t-butylphenol), 4,4'-methylenebis(2,6-di-butylphenol), 2,2'-methylenebis(2-t-butyl-4-ethylphenol), 2,6-bis(2-hydroxy-3-t-butyl-5-methyl-benzyl)-4-methylphenol, 3,3',5,5'-tetra-t-butyl-4,4'-dihydroxy-biphenyl, l-ascorbic acid, l-ascorbic acid monoester, l-ascorbic acid diester, p-oxyphenylglycine, N,N-diethyl-p-phenylenediamine, phloin, benzoin, dihydroxyacetone, glyceraldehyde, rodizonic acid-tetrahydroxyquinone, methyl gallate, propyl gallate, hydroxytetronic acid, N,N-di(2-ethoxyethyl)hydroxylamine, glucose, lactose, 1-phenyl-3-pyrazolidone, 4-methyl-4-hydroxy-methyl-1-phenyl-3-pyrazolidone, bis(3-methyl-4-hydroxy-5-t-butylphenyl)sulfide, 3,5-di-t-butyl-4-hydroxyvbenzyl-dimethylamine and $\alpha,\alpha'$-(3,5-di-t-butyl-4-hydroxyphenyl)-dimethyl ether. These reducing agents can be used alone or in admixture.

A suitable reducing agent is chosen depending on the combination with an organic silver salt. For a silver salt of a higher fatty acid such as silver behenate, which is relatively difficult to reduce, a relatively strong reducing agent, for example, a bisphenol such as 4,4'-methylenebis-(3-methyl-5-t-butylphenol), is suitable. For a silver salt which is relatively easy to reduce, such as silver laurate, on the other hand, a relatively weak reducing agent, for example, a substituted phenol such a p-phenylphenol, is suitable. For a silver salt which is extremely difficult to reduce, such as silver benzotriazole, a strong reducing agent, for example, ascorbic acid or derivative thereof, is suitable.

The quantity of the reducing agent of the invention as described above will vary depending on the organic silver salt and the reducing agent and, therefore, the quantity cannot be set forth unequivocably. However, in general, the amount is about 0.1 to 5 mols per 1 mol of the organic silver salt (a).

As is apparent from the foregoing description, a suitable reducing agent is chosen for a specific organic silver salt for the purpose of preparing a thermally developable photosensitive material.

The photosensitive silver halide (Component b)) of the invention can be silver chloride, silver bromide, silver bromoiodide, silver chlorobromoiodide, silver chlorobromide, silver iodide and mixtures thereof. These photosensitive silver halides can be used either as fine grains or as coarse grains, but an emulsion of very fine grains is particularly useful. A suitable particle size ranges from about 0.01 $\mu$ to 0.5 $\mu$, preferably 0.03 $\mu$ to 0.3 $\mu$. An emulsion containing a light-sensitive silver halide can be prepared using any of the known methods used in the field of photography. Examples of suitable emulsions are an emulsion prepared by the single jet process, an emulsion prepared by the double jet process, for example, a Lipmann emulsion, an emulsion prepared by the ammonia method and a thiocyanate or thioether emulsion, for example, emulsions as described in U.S. Pat. Nos. 2,222,264; 3,320,069 and 3,271,157.

The silver halide used for the practice of the present invention can be sensitized with a chemical sensitizer such as sulfur or selenium compounds, gold, platinum or palladium compounds, or mixtures thereof, for example, using the methods described in U.S. Pat. Nos. 2,623,499; 2,399,083; 3,297,447 or 3,297,446.

As described above, a catalytic amount of the photosensitive silver halide can be previously prepared and used as one component of the photosensitive layer used in the invention, but, more preferably, a halide compound capable of forming a catalytic amount of a photosensitive silver halide is reacted with the organic silver salt (a) as a component of the photosensitive layer of the invention, thereby forming the silver halide from a portion of the organic silver salt. For example, a solution of a halide such as ammonium bromide can be added to a polymer dispersion of an organic silver salt such as silver laurate. It is apparent from the change in the X-ray diffraction pattern that a portion of the silver laurate and ammonium bromide are reacted to form silver bromide.

Halides suitable for use in the invention include inorganic halides and organic halides. The inorganic halides can be represented by the formula $MX_n'$, wherein M is a hydrogen atom, an ammonium group or a metal atom, X' is a halogen atom and n is the valency of M. Illustrative inorganic halides are hydrogen halides, ammonium halides and strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, manganese, gallium, indium, rhodium, ruthenium, palladium, iridium, platinum, thallium and bismuth halides. These halides include chlorides, bromides, iodides and mixtures thereof. Examples of organic halides which can be used include triphenylmethyl chloride, triphenylmethyl bromide, 2-bromo-2-methylpropane, 2-bromobutyric acid, 2-bromoethanol, dichlorobenzophenone, iodoform, bromoform and carbon tetrabromide.

A catalytic amount of the photosensitive silver halide or a halide capable of forming the photosensitive silver halide is ordinarily present in an amount of about 0.001 to 0.5 mol per 1 mol of the organic silver salt (a). If less than about 0.001 mol is present the sensitivity is reduced. If greater than about 0.5 mol, the quantity of a silver halide formed is too great, which means that when the thermally developed material is allowed to stand under light in a room, the non-image areas tend to blacken gradually, resulting in a deterioration in the contrast with the image area, since silver halides have a tendency to be darkened on exposure to room light.

A binder can be incorporated in the thermally developable light-sensitive material composition used for the practice of the invention. A suitable binder material is ordinarily hydrophobic, but can be hydrophilic. Suitable binders can be transparent or semi-transparent natural materials such as gelatin, gelatin derivatives and cellulose derivatives and synthetic materials such as polyvinyl compounds and acrylamide polymers. Other synthetic polymeric compounds are dispersed vinyl compounds of a latex type. Furthermore, desirable high molecular weight materials and resins include polyvinyl butyral, cellulose acetate butyrate, polymethyl methacrylate, polyvinylpyrrolidone, ethyl cellulose, polystyrene, polyvinyl chloride, chlorinated rubbers, polyisobutylene, butadiene-styrene copolymers, vinyl chloride-vinyl acetate copolymers, vinyl acetate-vinyl chloride-maleic acid copolymers and polyvinyl alcohol. The amount of the binder generally employed ranges from about 4:1 to 1:4 by weight based on the organic silver salt (a).

Any materials can be used as a support for the thermally developable photosensitive material of the invention. Typical supports are a cellulose nitrate film, a cellulose ester film, a poly(vinyl acetal) film, a polystyrene film, a poly(ethylene terephthalate) film, a polycarbonate film and other resinous materials, glass, paper and metals. A suitable coating amount of the organic silver salt (a) can range from about 0.2 to 2.5 g, preferably 0.3 to 1.5 g, as silver per square meter of the support.

An antistatic layer or an electrically conductive layer can be provided on the thermally developable photosensitive material of the invention, if desired. Moreover, an antihalation material or antihalation dye can be incorporated therein. If desired, a matting agent such as kaolin, starch, titanium dioxide, zinc oxide or silica ca be incorporated in the overcoated polymer layer in the thermally developable photosensitive material of the invention or these matting agents can be incorporated in the photosensitive layer. Fluorescent brightening agents such as the stilbenes, triazines, oxazoles and coumarins can be incorporated, if desired.

The thermally developable photosensitive layer and overcoated layer of the present invention can be coated using various coating methods, for example, an immersion method, an air knife method, a curtain coating method and an extrusion coating method using a hopper as described in U.S. Pat. No. 2,681,294. If desired, two or more layers of the photosensitive layer and the overcoated layer can be simultaneously coated.

An optical sensitizer can be advantageously used for the purpose of enhancing the photosensitivity of the element of the invention. Optical sensitization can be carried out, for example, by adding a sensitizing dye in the form of a solution in an organic solvent or a dispersion. The sensitizing dye is ordinarily selected from acidic dyes such as halogen substituted fluoresceins, styrylquinoline dyes, rhodacyanine dyes, merocyanine dyes and cyanine dyes. Suitable sensitizing dyes which can be used are disclosed, for example, in U.S. Pat. Nos. 3,457,075; 3,719,495; 3,761,279; etc.

The above described thermally developable photosensitive material is exposed for about $10^{-6}$ to 60, preferably $10^{-5}$ to 10 seconds to radiation from a light source such as a xenon lamp, a tungsten lamp or a mercury lamp to form a latent image which can be developed simply by heating. Therefore, another embodiment of the invention is a method of developing a latent image in the exposed thermally developable photosensitive material by heating the element at about 100° to 180° C until the desired image is developed.

The developing temperature generally ranges from about 100° to 180° C, preferably 110° to 160° C. A higher temperature or a lower temperature within this range can be used by appropriately increasing or decreasing the heating time. A stable developed image is ordinarily obtained in about 1 to 60 seconds.

The development by heating can be by using various means, for example, by contacting the above described thermally developable photosensitive element with a simple heating plate or heating drum or, as the occasion demands, by passing the thermally developable photosensitive element through a heated space or by subjecting the element to high frequency heating.

The thus imagewise exposed and thermally developed material is contacted with a polymer film containing a stabilizer of the above described general formula and then subjected to a pressure and/or to heat to thus obtain a thermally developed material stable to light and heat. While not desiring to be bound, it is believed that the stabilizer of the invention reacts with an organic silver salt and/or a silver halide in the thermally developable photosensitive layer to stop the developing action.

Some preferred embodiments of the invention are described in detail below. In one embodiment, a thermally developable photosensitive element comprising a support having theron a thermally developable photosensitive layer containing at least (a) an organic silver salt, (b) a catalytic amount of a photosensitive silver halide or compound capable of forming a silver halide upon reaction with the organic silver salt (a), (c) a reducing agent and (d) a binder is firstly imagewise exposed. A polymer film sheet containing the stabilizer of this invention is then prepared on the other hand and contacted with the imagewise exposed photosensitive sheet, followed by heating. In this embodiment, the heating temperature should be the developing temperature, that is, about 100° to 180° C, preferably 110° to 160° C and the heating time is preferably about 1 to 60 seconds. In this case, it is desirable that the contact surface of the polymer film containing the stabilizer with the photosensitive element be adhesive at least when heated. Thus the polymer film sheet containing the stabilizer is adhered to the photosensitive element to give a image elememt stable to light and heat. This image is more stable than the image attained on an ordinary photosensitive element and the development does not proceed further even under white light or even when allowed to stand in a room at a high temperature.

In a further preferred embodiment of the invention a photosensitive element similar to the above is imagewise exposed and then heated at about 100° to 180° C for about 1 to 60 seconds to obtain a photosensitive element having an image. This photosensitive element and a polymer film sheet containing the stabilizer of the invention are stacked and subjected to a pressure and/or heat, thus obtaining an image element stable to light and heat. Even if this image element is exposed to white light for a long time or to a high temperature for a long time, development does not proceed further.

It is particularly preferable that the contact surface of the polymer film sheet with the photosensitive element is rendered adhesive. As is well known, a laminate film can be used. In this case, the heating temperature can be the developing temperature (100°–180° C), but preferably, a temperature of about 40° to 100° C is employed. The heating time is ordinarily about 1 to 60 seconds. The pressure can be applied with the hands or by passing the element through two rolls.

The polymer film sheet containing the stabilizer of the invention can be stripped off after such processing.

Other preferred embodiments of the invention are combinations of the above described embodiments. For example, the photosensitive element is imagewise exposed, heated and developed partly, contacted with a polymer film sheet containing the stabilizer, heated at about 100° to 180° C (developing temperature), if desired while applying a pressure, to complete the development, and thus stabilized.

The following examples are given to illustrate the invention in greater detail. Unless otherwise indicated, all parts, percents, ratios and the like are by weight.

EXAMPLE 1

11 g of lauric acid was dissolved in 100 ml of butyl acetate and the resulting solution was kept at 10° C. To the solution were added with stirring by means of a stirrer 100 ml of a dilute aqueous solution of nitric acid (25° C, pH = 2.0) and 50 ml of an aqueous solution of silver ammonium complex salt containing 8.5 g of silver nitrate (cooled to 0° C) for 1 minute, thus reacting the lauric acid and the silver ion and obtaining spindle-shaped silver laurate crystals having a length of about 1 micron and width of about 0.05 micron. After washing this silver salt with water and further with methanol, 3.0 g of polyvinyl butyral and 20 ml of isopropyl alcohol were added to 2.7 g of the silver laurate and dispersed in a ball mill to prepare a silver salt polymer dispersion.

To this dispersion was added the following composition to prepare a thermally developable photosensitive element. This element will hereinafter be referred to as "Silver Laurate Coated Sample".

| | |
|---|---|
| HBr (2% methanol solution) (silver halide forming agent) | 2 ml |
| 2',7'-Dichlorofluorescein (sensitizing dye, 0.025% methanol solution) | 3 ml |
| Phthalazinone (toning agent) (5% methyl Cellosolve solution) | 10 ml |
| p-Phenylphenol (20% acetone solution) | 10 ml |

To the silver salt polymer dispersion were added these materials at 40° C in the above described order over a period of 5 minutes to prepare a coating liquid and the coating liquid was coated onto a sheet of art paper to give a coated silver quantity of 0.8 g per 1 $m^2$ of support, followed by drying at 60° C for 30 minutes to obtain a sample. The thus resulting silver laurate coated sample was imagewise exposed through a step wedge having a gradation and then heated at 120° C for 20 seconds to obtain an image having a gradation. This will hereinafater be designated "image sheet".

When a sample of this image sheet was allowed to stand under white light for several hours, a non-image area (which will hereinafter be designated "background area") was gradually developed and changed to brown. When this sample of the image sheet was exposed to a white lamp and then heated again at 120° C, the background area blackened immediately and the image disappeared.

A commercially available cellophane adhesive tape was impregnated with a 5% methanol solution of 1-phenyl-5-mercaptotetrazole, a stabilizer of the invention, and applied to a sample of the above described image sheet. In this case, blackening of the background area hardly took place even if the sample of the image sheet was allowed to stand under a white lamp or even if the sample of the image sheet was heated again at a high temperature (120° C).

EXAMPLES 2–5

When commercially available cellophane adhesive tapes were impregnated with other stabilizers, for example, a 5% ethanol solution of 3-mercapto-4-phenyl-1,2,4-triazole, a 2% methanol solution of 2-mercaptobenzimidazole, a 2% methanol solution of 2-thiohydantoin and a 2% methanol solution of 3-phenyl-2-oxadiazoline-5-thione and applied similarly to samples of the image sheet produced as described in Example 1, the light and heat stability of the background area were increased in a similar manner.

EXAMPLE 6

3.4 g of behenic acid was dissolved in 100 ml of toluene at 60° C and kept at 60° C. To this solution was added with agitation a solution of 0.1 g of mercuric nitrate dissolved in 100 ml of a dilute aqueous solution of nitric acid (pH = 2.0, 25° C). To the mixed solution kept at 60° C was added with stirring by means of a stirrer an aqueous solution prepared by adding aqueous ammonia to about 80 ml of an aqueous solution containing 1.7 g of silver nitrate to form a silver ammonium complex salt and then adding water to make the total volume 100 ml, thus obtaining a dispersion containing fine crystals of silver behenate. When this dispersion was allowed to stand at room temperature for 20 minutes, phase separation took place into an aqueous phase and toluene phase. The aqueous phase was first removed and 400 ml of fresh water was added with washing using decantation. This procedure was repeated three times and then 400 ml of methanol was added, followed by a centrifugal separation, thus obtaining 4.1 g of silver behenate spherical grains of a diameter of about 0.3 micron. 2.5 g of this silver behenate was added to 20 ml of an isopropyl alcohol solution containing 2 g of polyvinyl butyral and the mixture was ball milled for 1 hour to prepare a silver salt polymer dispersion. To 20 ml of the resulting silver salt polymer dispersion were added the following components and the mixture was applied to a support of baryta paper to give a coated silver quantity of 1.1g per 1 $m^2$ of support, thus obtaining a thermally developable photosensitive material.

| | |
|---|---|
| Ammonium Bromide (2.5% by weight methanol solution) (silver halide forming agent) | 1 ml |
| Benzoxazolilidene Rhodanine Sensitizing Dye (0.025% by weight chloroform solution) | 1 ml |
| 2,2'-Methylene-bis(6-t-butyl-4-methylphenol) (25% by weight methyl Cellosolve solution) | 3 ml |
| Phthalazinone | 1 ml |

-continued

| | |
|---|---|
| (2.5% by weight methyl Cellosolve solution) | |

The thus prepared photosensitive sheet was imagewise exposed through a transparent original and heated at 140° C for 10 seconds to obtain an image (which will hereinafter be designated "image sheet").

On the other hand, onto a polyethylene terephthalate film was coated 100 ml of an isopropanol solution containing 5 g of polyvinyl butyral and 1 g of 1-phenyl-5-mercaptotetrazole to obtain a stabilizing sheet (which will hereinafter be designated "stabilizing sheet").

The image sheet and stabilizing sheet were combined so that the coated film surfaces faced each other and heated 120° C for 10 seconds. Both the sheets were adhered to obtain a sheet stabilized to light and heat.

The similar effects were also found when using the other stabilizers described in Examples 1 to 5 in place of the 1-phenyl-5-mercaptotetrazole.

Similar effects were also found when the film surface of the image sheet was laminated with a composite film of polyethylene terephthalate containing 5% by weight of 1-phenyl-5-mercaptotetrazole (10 microns) and polyethylene (15 microns).

EXAMPLE 7

6 g of benzotriazole was dissolved in 100 ml of isoamyl acetate at 50° C and cooled to −15° C. To the solution was added with stirring by means of a stirrer a solution of 0.25 g of mercuric nitrate and 8.5 g of silver nitrate dissolved in 100 ml of a dilute aqueous solution of nitric acid (pH = 2.0, 25° C) and kept at 3° C, thus obtaining a dispersion containing fine crystals of silver benzotriazole. When this dispersion was allowed to stand at room temperature for 20 minutes, phase separation into an aqueous phase and an isoamyl acetate phase took place. The aqueous phase was first removed and 400 ml of fresh water was added for washing by decantation. This procedure was repeated three times and then 400 ml of methanol was added, followed by centrifugal separation, thus obtaining 8 g of silver benzotriazole in a substantially spherical form of a diameter of about 0.04 micron. 2.5 g of this silver benzotriazole was added to 40 ml of an isopropyl alcohol solution containing 4 g of polyvinyl butyral and the mixture was ball milled for 4 hours to prepare a silver salt polymer dispersion.

To 40 ml of the resulting polymer dispersion of the silver salt were added the following components and the mixture was applied to a support of a polyethylene terephthalate film to provide a coated silver amount of 1.8 g per 1 $m^2$ of the support, thus obtaining a thermally developable photosensitive material.

| | |
|---|---|
| Ammonium Iodide (8.5% by weight methanol solution) | 1 ml |
| Ascorbic Acid Monopalmitate and Ascorbic Acid Dipalmitate (methyl Cellosolve solution containing 2 g of each ester) | 10 ml |
| Benzoxazolilidene Rhodanine Sensitizing Dye (0.2% by weight chloroform solution) | 1 ml |
| N-Ethyl-N'-dodecylurea (2.5% by weight methyl Cellosolve solution) | 2 ml |

In a manner analogous to Example 6, a sheet having an image stabilized to light and heat was obtained.

The stabilizing effect of the above described cellophane tape impregnated with a stabilizer of the invention was similarly found for a sample of an image sheet obtained similarly from Dry Silver Paper (Type 777), trade name, manufactured by 3M Co.

Similar effects to these examples were also found when using other fatty acid silver salt coated samples, for example, using silver myristate, silver palmitate, silver stearate and silver behenate coated samples, and furthermore, using samples coated with other silver salts as described in this specification, for example, a silver benzotriazole coated sample.

While the invention has been described in detail and with reference to specific embodiments thereof, it will be apparent to one skilled in the art that various changes and modifications can be made therein without departing from the spirit and scope thereof.

What is claimed is:

1. In a method for forming an image in a thermally developable photosensitive material which comprises imagewise exposing a thermally developable photosensitive material comprising a support having thereon a layer containing at least (a) an organic silver salt; (b) a catalytic amount of a photosensitive silver halide or a compound capable of forming a silver halide upon reaction with the organic silver salt (a); (c) a reducing agent and (d) a binder and heating the thermally developable photosensitive material, the improvement which comprises stabilizing the image formed by contacting the photosensitive layer of the photosensitive material during or after the heating with a polymer film layer containing a compound represented by the following general formula

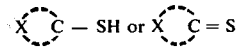

in which X represents the non-metallic atoms necessary for forming a 5- or 6-membered heterocyclic ring containing at least one of a nitrogen, oxygen or sulfur hetero atom, said compound of the general formula being present in an amount sufficient to stabilize said image.

2. The method of claim 1, wherein said heterocyclic ring formed by X is selected from the group consisting of an imidazolyl ring, a benzoimidazolyl ring, a thiazolyl ring, a benzothiazolyl ring, an oxazolyl ring, a benzoxazolyl ring, a triazolyl ring, a thiadiazolyl ring, an oxadiazolyl ring, a tetrazolyl ring, a pyridyl ring, a pyrimidyl ring, a pyrazinyl ring, a pyridazinyl ring and a triazinyl ring.

3. The method of claim 1, wherein said compound represented by the general formula is 2-mercaptoimidazole, 2-mercaptobenzoimidazole, 5-carboethoxy-2-mercapto-4-methylthiazole, 2-mercaptobenzothiazole, 2-mercaptoxazole, 2-mercaptobenzoxazole, 3-mercapto-4-phenyl-1,2,4-triazole, 3-mercapto-4,5-dimethyl-1,2,4-triazole, 4-mercapto-6-methyl-1,3,3a,7-tetrazaindene, 2-methylthio-4-methyl-thiadiazole-5-thione, 3-phenyl-2-oxadiazoline-5-thione, 1-phenyl-5-mercaptotetrazole, 3-mercaptopyridine, 4-hydroxy-2-mercapto-6-methylpyrimidine, 2-mercaptopyrazine, 3-mercaptopyridazine or 2,4,6-trimercapto-1,3,5-triazine.

4. The method of claim 1, wherein said polymer film layer containing the compound of the general formula is polyvinyl chloride, polyvinyl acetate, a copolymer of vinyl chloride and vinyl acetate, polyvinyl butyral, polystyrene, polymethyl methacrylate, a polyurethane rubber, a xylene resin, benzyl cellulose, a copolymer of vinyl chloride and vinylidene chloride, a fluoroethylene resin, nylon-6, a regenerated cellulose, ethyl cellulose, cellulose acetate butyrate, cellulose acetate, polyvinylidene chloride, chlorinated polypropylene, polyvinyl pyrrolidone, cellulose propionate, polyvinyl formal, cellulose acetate phthalate, polycarbonate, cellulose acetate propionate, gelatin, a gelatin derivative, a polyacrylamide, a chlorinated rubber, polyisobutylene, polyethylene, polypropylene, polyethylene terephthalate, a co-polymer of butadiene and styrene, polyvinyl alcohol or a composite film thereof.

5. The method of claim 1, wherein the compound represented by the general formula is present at about 0.1 to 200 parts by weight per 100 parts by weight of the polymer forming the polymer film layer.

6. The method of claim 1, wherein the polymer film layer has a thickness of about 1 to 500 microns.

7. The method of claim 1, wherein said contacting is using a polymer film layer having thereon an adhesive layer and adhering said polymer film layer to said photosensitive layer of said photosensitive material.

8. The method of claim 1, wherein the compound represented by the general formula is coated on said polymer film layer or incorporated into said polymer film layer during the preparation of said polymer film layer.

9. The method of claim 1, wherein said organic silver salt is a silver salt of an organic compound having an imino group, a mercapto group, or a carboxyl group.

10. The method of claim 1, wherein said photosensitive silver halide is silver chloride, silver bromide, silver iodide or mixtures thereof and wherein said compound capable of forming a silver halide upon reaction with the organic silver salt (a) is an inorganic halide having the formula $MX_n'$, wherein M is a hydrogen atom, an ammonium group or a metal atom; X′ is a halogen atom; and $n$ is the valency of M or an organic halide selected from the group consisting of triphenylmethyl chloride, triphenylmethyl bromide, 2-bromo-2-methylpropane, 2-bromobutyric acid, 2-bromoethanol, dichlorobenzophenone, iodoform, bromoform and carbon tetrabromide.

11. The method of claim 1, wherein said reducing agent is a substituted phenol, a substituted or unsubstituted bisphenol, a substituted or unsubstituted naphthol, a di- or polyhydroxybenzene, a di- or polyhydroxynaphthalene, a hydroquinone monoether, ascorbic acid or a derivative thereof, a 3-pyrazolidone, a pyrazoline-5-one, a reducing saccharide, kojic acid or hinokitiol.

12. The method of claim 1, wherein said heating is at a temperature of about 100° to 180° C for 1 to 60 seconds.

13. The method of claim 1, wherein said contacting is during said heating.

14. The method of claim 1, wherein said contacting is after said heating.

15. The method of claim 1, further including removing said polymer film after said heating.

16. The method of claim 4, wherein said polyolefin is polyethylene or polypropylene.

17. The method of claim 4, wherein said polyester is polyethylene terephthalate.

18. The method of claim 4, wherein said composite is a copolymer of vinyl chloride and vinylidene chloride/polyethylene, polyethylene terephthalate/a copolymer of vinyl chloride and vinylidene chloride, polyethylene terephthalate/polyvinyl alcohol/polyethylene, polypropylene/polyvinyl alcohol/polyethylene, polyethylene, terephthalate/polyvinyl alcohol/polypropylene, cellulose triacetate/polyvinyl alcohol/polypropylene, polyethylene terephthalate/regenerated cellulose/polyethylene, cellulose triacetate/regenerated cellulose/polyethylene, polypropylene/regenerated cellulose/polyethylene, cellulose triacetate/nylon-6/polyethylene, polyethylene terephthalate/nylon-6/polyethylene or polypropylene/nylon-6-/polyethylene.

19. The method of claim 9, wherein said organic silver salt is silver benzotriazole, silver saccharin, silver phthalazinone, silver 3-mercapto-4-phenyl-1,2,4-triazole, silver 4-hydroxy-6-methyl-1,3,3a,7-tetrazaindene, silver 2-(S-ethylthioglycolamido)-benzothiazole, silver caprate, silver laurate, silver myristate, silver palmitate, silver stearate, silver behenate, silver adipate or silver sebacate.

20. The method of claim 11, wherein said reducing agent is hydroquinone, methylhydroquinone, chlorohydroquinone, bromohydroquinone, phenylhydroquinone, hydroquinonemonosulfonate, t-octylhydroquinone, t-butylhydroquinone, 2,5-dimethylhydroquinone, 2,6-dimethylhydroquinone, methoxyhydroquinone, ethoxyhydroquinone, p-methoxyphenol, p-ethoxyphenol, hydroquinone monobenzyl ether, catechol, pyrogallol, resorcinol, p-aminophenol, o-aminophenol, N-methyl-p-aminophenol, 2-methoxy-4-aminophenol, 2,4-diaminophenol, 2-β-hydroxyethyl-4-aminophenol, p-t-butylphenol, p-t-amylphenol, p-cresol, 2,6-di-t-butyl-p-cresol, p-acetophenol, p-phenylphenol, o-phenylphenol, 1,4-dimethoxyphenol, 3,4-xylenol, 2,4-xylenol, 2,6-dimethoxyphenol, sodium 1-amino-2-naphthaol-6-sulfonate, 1-naphthylamine-7-sulfonic acid, 1-hydroxy-4-methoxynaphthalene, 1-hydroxy-4-ethoxy-naphthalene, 1,4-dihydroxynaphthalene, 1,3-dihydroxynaphthalene, 1-hydroxy-4-aminonaphthalene, 1,5-dihydroxynaphthalene, 1-hydroxy-2-phenyl-4-methoxynaphthalene, 1-hydroxy-2-methyl-4-methoxynaphthalene, α-naphthol, β-naphthol, 1,1′-dihydroxy-2,2′-binaphthyl, 4,4′-dimethoxy-1,1′-dihydroxy-2,2′-binaphthyl, 6,6′-dinitro-2,2′-dihydroxy-1,1′-binaphthyl, bis(2-hydroxy-1-naphthyl)methane, bisphenol A, 1,1-bis -(2-hydroxy-3,5-dimethylphenyl)-3,5,5-trimethylhexane, 2,4,4-trimethylpentyl-bis-(2-hydroxy-3,5-dimethylphenyl)methane, bis(2-hydroxy-3-t-butyl-5-methylphenyl)methane, bis(2-hydroxy-3,5-di-t-butylpenyl)methane, 4,4′-methylenebis(3-methyl-5-t-butylphenol), 4,4′-methylenebis(2,6-di-butylphenol), 2,2′-methylenebis(2-t-butyl-4-ethylphenol), 2,6-bis(2-hydroxy-3-t-butyl-5-methyl-benzyl)-4-methylphenol, 3,3′,5,5′-tetra-t-butyl-4,4′-dihydroxy-biphenyl, l-ascorbic acid, l-ascorbic acid monoester, l-ascorbic acid diester, p-oxyphenylglycine, N,N-diethyl-p-phenylenediamine, phloin, benzoin, dihydroxyacetone, glyceraldehyde, rodizonic acid-tetrahydroxyquinone, methyl gallate, propyl gallate, hydroxytetronic acid, N,N-di(2-ethoxyethyl)hydroxylamine, glucose, lactose, 1-phenyl-3-pyrazolidone, 4-methyl-4-hydroxy-methyl-1-phenyl-3-pyrazolidone, bis(3-methyl-4-hydroxy-5-t-butylphenyl)sulfide, 3,5-di-t-butyl-4-hydroxybenzyl-dimethylamine or α,α′-(3,5-di-t-butyl-4-hydroxyphenyl)-dimethyl ether.

21. The method of claim 1, wherein said organic silver salt (a) is present in an amount of form about 0.2 to 2.5 g, as silver, per square meter of said support; said catalytic amount of said photosensitive silver halide or said compound capable of forming a silver halide upon reaction with said organic silver salt (a) is present in an amount of about 0.001 to 0.5 mol per mol of said organic silver salt (a); said reducing agent is present in an amount of about 0.1 to 5 mols per mol of said organic silver salt (a) and said binder is present in a weight ratio of about 4:1 to 1:4 based on the weight of said organic silver salt (a).

* * * * *